US007802377B2

(12) United States Patent
Kloibhofer et al.

(10) Patent No.: US 7,802,377 B2
(45) Date of Patent: Sep. 28, 2010

(54) DRYING CYLINDER

(75) Inventors: Rainer Kloibhofer, Neumarkt (AT); Christoph Haase, Asperhofen (AT); Thomas Gruber-Nadlinger, Langenrohr (AT); Herbert Boden, Pölten (AT); Erich Rollenitz, Pölten (AT); Manfred Gloser, Pölten (AT)

(73) Assignee: Voith Patent GmbH, Heidenheim (DE)

( * ) Notice: Subject to any disclaimer, the term of this patent is extended or adjusted under 35 U.S.C. 154(b) by 300 days.

(21) Appl. No.: 11/769,819

(22) Filed: Jun. 28, 2007

(65) Prior Publication Data

US 2007/0294914 A1 Dec. 27, 2007

Related U.S. Application Data

(63) Continuation of application No. PCT/EP2005/056151, filed on Nov. 22, 2005.

(30) Foreign Application Priority Data

Jan. 5, 2005 (DE) ..... 10 2005 000 782

(51) Int. Cl.
*F26B 11/02* (2006.01)

(52) U.S. Cl. ..... 34/110; 34/117; 34/120; 34/121; 34/122; 34/125; 34/90; 166/272.1; 166/261; 126/400; 310/12.11

(58) Field of Classification Search ..... 34/108, 34/110, 117, 120, 121, 122, 125, 90; 166/272.1, 166/261; 126/400; 310/12.11
See application file for complete search history.

(56) References Cited

U.S. PATENT DOCUMENTS 1,453,113 A * 4/1923 Hutchins ..... 34/125
1,988,677 A 1/1935 Arnold
1,988,678 A 1/1935 Arnold
2,029,854 A * 2/1936 Cannity ..... 226/41
2,074,455 A 3/1937 Carleton
2,412,733 A 12/1946 Hornbostel
2,433,121 A * 12/1947 Hornbostel ..... 34/124
2,534,127 A * 12/1950 Howe ..... 264/662

(Continued)

FOREIGN PATENT DOCUMENTS

EP 0559628 A1 9/1993
EP 1 048 782 * 11/2000 ..... 34/110
WO WO02/095125 11/2002

OTHER PUBLICATIONS

International Search Report of PCT/EP2005/056166 (totaling 3 pages), dated Apr. 2006.
International Search Report of PCT/EP2005/056144 (totaling 3 pages), dated Feb. 2006.

*Primary Examiner*—Stephen M. Gravini
(74) *Attorney, Agent, or Firm*—Taylor IP, PC

(57) ABSTRACT

The invention relates to a drying cylinder which is used to dry a paper, cardboard, tissue or other web of fibrous material in a machine for the production and/or for the transformation thereof. The drying cylinder includes a support body and an external cover layer which is heated by a hot fluid. The thermal flow passing through the external cover layer is increased such that at least one cavity is provided between the support body and the external cover layer through which the fluid flows. The external cover layer is predominately so thin that the ratio formed by the thermal conductivity of the material and the thickness of the external cover layer is greater than a threshold value of 3.2 $kW/m^2K$ for steel, 30 $kW/m^2K$ for aluminum, 18 $kW/m^2K$ for bronze alloys, 3.4 $kW/m^2K$ for copper and 6.1 $kW/m^2K$ for magnesium.

19 Claims, 2 Drawing Sheets

U.S. PATENT DOCUMENTS

| | | | | | |
|---|---|---|---|---|---|
| 2,563,692 | A | | 8/1951 | Ostertag et al. | |
| 2,576,036 | A | | 11/1951 | Ostertag et al. | |
| 2,582,365 | A | | 1/1952 | Westphal | |
| 2,586,829 | A | | 2/1952 | Kelsey | |
| 2,618,865 | A | | 11/1952 | Arnold | |
| 2,648,914 | A | | 8/1953 | Engstrom | |
| 2,661,545 | A | | 12/1953 | Messinger | |
| 2,661,546 | A | | 12/1953 | Petry et al. | |
| 2,677,898 | A | | 5/1954 | Ohlson et al. | |
| 2,677,899 | A | | 5/1954 | Ohlson et al. | |
| 2,697,284 | A | | 12/1954 | Charlton et al. | |
| RE24,024 | E | | 6/1955 | Ohlson et al. | |
| 2,725,640 | A | | 12/1955 | Voigtman | |
| 2,817,908 | A | | 12/1957 | Hornbostel | |
| 2,822,153 | A | | 2/1958 | Arnold | |
| 2,893,136 | A | | 7/1959 | Justus et al. | |
| 2,915,293 | A | | 12/1959 | Justus et al. | |
| 2,932,091 | A | | 4/1960 | Day | |
| 2,964,297 | A | * | 12/1960 | Davis et al. | 165/68 |
| 3,060,592 | A | | 10/1962 | Ostertag | |
| 3,065,552 | A | | 11/1962 | Skinner | |
| 3,099,543 | A | | 7/1963 | Malmstrom et al. | |
| 3,110,612 | A | * | 11/1963 | Gottwald et al. | 427/362 |
| 3,169,050 | A | | 2/1965 | Kroon | |
| 3,177,932 | A | | 4/1965 | Smith, Jr. | |
| 3,181,605 | A | | 5/1965 | Smith, Jr. | |
| 3,224,110 | A | | 12/1965 | Kroon | |
| 3,228,462 | A | | 1/1966 | Smith, Jr. | |
| 3,319,352 | A | * | 5/1967 | Haigh | 34/123 |
| 3,328,897 | A | | 7/1967 | Purkett | |
| 3,354,035 | A | * | 11/1967 | Gottwald et al. | 162/206 |
| 3,487,187 | A | | 12/1969 | Martens et al. | |
| 3,633,662 | A | | 1/1972 | Voll | |
| 3,643,344 | A | * | 2/1972 | Strube | 34/124 |
| 3,799,052 | A | * | 3/1974 | Kusters et al. | 100/313 |
| 3,838,734 | A | * | 10/1974 | Kilmartin | 165/90 |
| 3,850,373 | A | | 11/1974 | Grolitsch | |
| 3,973,483 | A | * | 8/1976 | Appenzeller | 100/302 |
| 4,064,608 | A | | 12/1977 | Jaeger | 29/132 |
| 4,077,466 | A | * | 3/1978 | Fleissner | 165/89 |
| 4,081,913 | A | * | 4/1978 | Salminen | 34/454 |
| 4,086,691 | A | | 5/1978 | Smith, Jr. | |
| 4,100,683 | A | * | 7/1978 | Barp et al. | 34/124 |
| 4,146,972 | A | | 4/1979 | Smith, Jr. | |
| 4,158,128 | A | * | 6/1979 | Evdokimov et al. | 219/469 |
| 4,183,298 | A | * | 1/1980 | Cappel et al. | 101/348 |
| 4,194,947 | A | * | 3/1980 | Huostila et al. | 162/207 |
| 4,196,689 | A | | 4/1980 | Wolf et al. | 165/91 |
| 4,252,184 | A | * | 2/1981 | Appel | 165/90 |
| 4,253,343 | A | * | 3/1981 | Black et al. | 474/135 |
| 4,254,561 | A | * | 3/1981 | Schiel | 34/124 |
| 4,261,112 | A | * | 4/1981 | Apitz | 34/119 |
| 4,262,429 | A | | 4/1981 | Avril | |
| 4,320,582 | A | | 3/1982 | Klippstein et al. | |
| 4,324,613 | A | * | 4/1982 | Wahren | 162/111 |
| 4,350,663 | A | | 9/1982 | McAlister | |
| 4,358,993 | A | * | 11/1982 | Spillmann et al. | 99/483 |
| 4,359,827 | A | * | 11/1982 | Thomas | 34/452 |
| 4,359,828 | A | * | 11/1982 | Thomas | 34/114 |
| 4,426,795 | A | * | 1/1984 | Rudt | 34/116 |
| 4,450,631 | A | | 5/1984 | Gamble | |
| 4,453,593 | A | | 6/1984 | Barthel et al. | |
| 4,461,095 | A | * | 7/1984 | Lehtinen | 34/392 |
| 4,494,319 | A | * | 1/1985 | Rudt | 34/116 |
| 4,622,758 | A | | 11/1986 | Lehtinen et al. | |
| 4,633,596 | A | * | 1/1987 | Josef | 34/116 |
| 4,710,271 | A | * | 12/1987 | Miller | 162/360.3 |
| 4,758,310 | A | * | 7/1988 | Miller | 162/358.5 |
| 4,781,795 | A | | 11/1988 | Miller | 162/359 |
| 4,829,681 | A | * | 5/1989 | Josef | 34/123 |
| 4,889,048 | A | * | 12/1989 | Miller | 100/313 |
| 4,899,811 | A | | 2/1990 | Wolf et al. | |
| 4,955,268 | A | | 9/1990 | Ickinger et al. | |
| 5,069,199 | A | * | 12/1991 | Messner | 126/400 |
| 5,103,898 | A | | 4/1992 | Krimsky | |
| 5,240,656 | A | * | 8/1993 | Scheeres | 264/297.1 |
| 5,363,821 | A | * | 11/1994 | Rao et al. | 123/193.2 |
| 5,482,637 | A | * | 1/1996 | Rao et al. | 508/100 |
| 5,499,464 | A | | 3/1996 | Geiger | |
| 5,564,494 | A | | 10/1996 | Salminen | |
| 5,566,473 | A | * | 10/1996 | Salminen | 34/454 |
| 5,590,476 | A | * | 1/1997 | Alakoski et al. | 34/117 |
| 5,590,704 | A | | 1/1997 | Eriksen et al. | |
| 5,598,649 | A | | 2/1997 | Geiger | |
| 5,651,235 | A | | 7/1997 | Ashley et al. | |
| 5,668,421 | A | * | 9/1997 | Gladish | 310/12.11 |
| 5,685,909 | A | | 11/1997 | Reich et al. | |
| 5,746,966 | A | * | 5/1998 | McDonald | 264/338 |
| 5,787,603 | A | * | 8/1998 | Steiner et al. | 34/117 |
| 5,899,264 | A | * | 5/1999 | Marschke | 165/89 |
| 5,901,462 | A | | 5/1999 | Rudd | |
| 5,983,993 | A | | 11/1999 | Watson et al. | |
| 6,012,234 | A | * | 1/2000 | Schiel | 34/119 |
| 6,018,870 | A | | 2/2000 | Marschke et al. | |
| 6,032,725 | A | * | 3/2000 | Marschke et al. | 165/90 |
| 6,039,681 | A | * | 3/2000 | Heinz-Michael | 492/20 |
| 6,100,508 | A | * | 8/2000 | Kubik | 219/469 |
| 6,158,501 | A | * | 12/2000 | Koivukunnas | 165/89 |
| 6,161,302 | A | | 12/2000 | Rantala | |
| 6,209,225 | B1 | * | 4/2001 | Villarroel et al. | 34/599 |
| 6,256,903 | B1 | | 7/2001 | Rudd | |
| 6,398,909 | B1 | | 6/2002 | Klerelid | |
| 6,488,816 | B1 | | 12/2002 | Klerelid | |
| 6,613,266 | B2 | * | 9/2003 | McDonald | 264/338 |
| 6,675,876 | B2 | | 1/2004 | Yamashita et al. | |
| 6,683,284 | B2 | * | 1/2004 | Nyman et al. | 219/469 |
| 6,701,637 | B2 | * | 3/2004 | Lindsay et al. | 34/71 |
| 6,782,947 | B2 | * | 8/2004 | de Rouffignac et al. | 166/245 |
| 6,790,315 | B2 | | 9/2004 | Klerelid | |
| 6,821,237 | B1 | | 11/2004 | Isometsaet et al. | 492/46 |
| 6,877,555 | B2 | * | 4/2005 | Karanikas et al. | 166/245 |
| 6,880,633 | B2 | * | 4/2005 | Wellington et al. | 166/245 |
| 6,915,570 | B1 | * | 7/2005 | Ohgoshi et al. | 29/895.32 |
| 6,915,850 | B2 | * | 7/2005 | Vinegar et al. | 166/272.2 |
| 6,918,442 | B2 | * | 7/2005 | Wellington et al. | 166/245 |
| 6,918,443 | B2 | * | 7/2005 | Wellington et al. | 166/245 |
| 6,923,257 | B2 | * | 8/2005 | Wellington et al. | 166/245 |
| 6,929,067 | B2 | * | 8/2005 | Vinegar et al. | 166/302 |
| 6,932,155 | B2 | * | 8/2005 | Vinegar et al. | 166/245 |
| 6,948,562 | B2 | * | 9/2005 | Wellington et al. | 166/272.1 |
| 6,951,247 | B2 | * | 10/2005 | de Rouffignac et al. | 166/245 |
| 6,964,300 | B2 | * | 11/2005 | Vinegar et al. | 166/245 |
| 6,966,374 | B2 | * | 11/2005 | Vinegar et al. | 166/272.3 |
| 6,969,123 | B2 | * | 11/2005 | Vinegar et al. | 299/3 |
| 6,981,548 | B2 | * | 1/2006 | Wellington et al. | 166/245 |
| 6,991,032 | B2 | * | 1/2006 | Berchenko et al. | 166/245 |
| 6,991,033 | B2 | * | 1/2006 | Wellington et al. | 166/245 |
| 6,991,036 | B2 | * | 1/2006 | Sumnu-Dindoruk et al. | 166/302 |
| 6,991,045 | B2 | * | 1/2006 | Vinegar et al. | 175/45 |
| 6,994,169 | B2 | * | 2/2006 | Zhang et al. | 166/302 |
| 6,997,518 | B2 | * | 2/2006 | Vinegar et al. | 299/5 |
| 7,004,247 | B2 | * | 2/2006 | Cole et al. | 166/60 |
| 7,004,251 | B2 | * | 2/2006 | Ward et al. | 166/245 |
| 7,011,154 | B2 | * | 3/2006 | Maher et al. | 166/245 |
| 7,013,972 | B2 | * | 3/2006 | Vinegar et al. | 166/257 |
| 7,025,123 | B1 | * | 4/2006 | Gerndt et al. | 165/90 |
| 7,032,660 | B2 | * | 4/2006 | Vinegar et al. | 166/245 |
| 7,040,397 | B2 | * | 5/2006 | de Rouffignac et al. | 166/245 |
| 7,040,398 | B2 | * | 5/2006 | Wellington et al. | 166/245 |
| 7,040,399 | B2 | * | 5/2006 | Wellington et al. | 166/245 |
| 7,040,400 | B2 | * | 5/2006 | de Rouffignac et al. | 166/245 |
| 7,051,807 | B2 | * | 5/2006 | Vinegar et al. | 166/245 |
| 7,051,808 | B1 | * | 5/2006 | Vinegar et al. | 166/250.1 |

7,051,811 B2 * 5/2006 de Rouffignac et al. ..... 166/302
7,055,600 B2 * 6/2006 Messier et al. ..... 166/250.01
7,060,163 B2 * 6/2006 Haider et al. ..... 162/375
7,063,145 B2 * 6/2006 Veenstra et al. ..... 166/250.01
7,066,254 B2 * 6/2006 Vinegar et al. ..... 166/245
7,066,257 B2 * 6/2006 Wellington et al. ..... 166/272.2
7,073,578 B2 * 7/2006 Vinegar et al. ..... 166/245
7,077,198 B2 * 7/2006 Vinegar et al. ..... 166/245
7,077,199 B2 * 7/2006 Vinegar et al. ..... 166/250.01
7,086,465 B2 * 8/2006 Wellington et al. ..... 166/272.1
7,090,013 B2 * 8/2006 Wellington ..... 166/267
7,096,942 B1 * 8/2006 de Rouffignac et al. ..... 166/245
7,100,994 B2 * 9/2006 Vinegar et al. ..... 299/7
7,104,319 B2 * 9/2006 Vinegar et al. ..... 166/245
7,104,788 B2 9/2006 Ebel et al.
7,114,566 B2 * 10/2006 Vinegar et al. ..... 166/256
7,121,341 B2 * 10/2006 Vinegar et al. ..... 166/302
7,121,342 B2 * 10/2006 Vinegar et al. ..... 166/302
7,128,153 B2 * 10/2006 Vinegar et al. ..... 166/285
7,156,176 B2 * 1/2007 Vinegar et al. ..... 166/302
7,165,615 B2 * 1/2007 Vinegar et al. ..... 166/302
7,217,114 B2 * 5/2007 Ohgoshi et al. ..... 425/130
7,219,734 B2 * 5/2007 Bai et al. ..... 166/302
7,220,365 B2 * 5/2007 Qu et al. ..... 252/70
7,225,866 B2 * 6/2007 Berchenko et al. ..... 166/245
7,320,364 B2 * 1/2008 Fairbanks ..... 166/302
7,353,872 B2 * 4/2008 Sandberg ..... 166/302
7,357,180 B2 * 4/2008 Vinegar et al. ..... 166/254.1
7,360,588 B2 * 4/2008 Vinegar et al. ..... 166/59
7,370,704 B2 * 5/2008 Harris ..... 166/302
7,383,877 B2 * 6/2008 Vinegar et al. ..... 166/60
7,424,915 B2 * 9/2008 Vinegar ..... 166/302
7,431,076 B2 * 10/2008 Sandberg et al. ..... 166/60
7,435,037 B2 * 10/2008 McKinzie, II ..... 405/130
7,461,691 B2 * 12/2008 Vinegar et al. ..... 166/60
7,464,644 B2 12/2008 Bernard et al.
7,481,228 B2 1/2009 Ragosta et al.
7,481,274 B2 * 1/2009 Vinegar et al. ..... 166/302
7,490,665 B2 * 2/2009 Sandberg et al. ..... 166/60
7,500,528 B2 * 3/2009 McKinzie et al. ..... 175/17
7,504,004 B2 * 3/2009 Michelotti ..... 162/359.1
7,510,000 B2 * 3/2009 Pastor-Sanz et al. ..... 166/60
7,527,094 B2 * 5/2009 McKinzie et al. ..... 166/250.07
7,533,719 B2 * 5/2009 Hinson et al. ..... 166/75.11
7,540,324 B2 * 6/2009 de Rouffignac et al. ..... 166/245
7,546,873 B2 * 6/2009 Kim et al. ..... 166/245
7,549,470 B2 * 6/2009 Vinegar et al. ..... 166/245
7,556,095 B2 * 7/2009 Vinegar ..... 166/250.01
7,556,096 B2 * 7/2009 Vinegar et al. ..... 166/250.01
7,559,367 B2 * 7/2009 Vinegar et al. ..... 166/272.3
7,559,368 B2 * 7/2009 Vinegar et al. ..... 166/272.6
7,562,706 B2 * 7/2009 Li et al. ..... 166/245
7,562,707 B2 * 7/2009 Miller ..... 166/245
7,575,052 B2 * 8/2009 Sandberg et al. ..... 166/248
7,575,053 B2 * 8/2009 Vinegar et al. ..... 166/250.14
7,581,589 B2 * 9/2009 Roes et al. ..... 166/267
7,584,789 B2 * 9/2009 Mo et al. ..... 166/267
7,591,310 B2 * 9/2009 Minderhoud et al. ..... 166/267
7,597,147 B2 * 10/2009 Vitek et al. ..... 166/302
7,604,052 B2 * 10/2009 Roes et al. ..... 166/267
7,610,962 B2 * 11/2009 Fowler ..... 166/267
7,631,689 B2 * 12/2009 Vinegar et al. ..... 166/245
7,631,690 B2 * 12/2009 Vinegar et al. ..... 166/245
7,635,023 B2 * 12/2009 Goldberg et al. ..... 166/245
7,635,024 B2 * 12/2009 Karanikas et al. ..... 166/245
7,635,025 B2 * 12/2009 Vinegar et al. ..... 166/272.3
7,640,980 B2 * 1/2010 Vinegar et al. ..... 166/268
7,644,765 B2 * 1/2010 Stegemeier et al. ..... 166/302
7,673,681 B2 * 3/2010 Vinegar et al. ..... 166/252.1
7,673,786 B2 * 3/2010 Menotti ..... 228/214
7,677,310 B2 * 3/2010 Vinegar et al. ..... 166/272.1
7,677,314 B2 * 3/2010 Hsu ..... 166/302
7,681,647 B2 * 3/2010 Mudunuri et al. ..... 166/302
7,683,296 B2 * 3/2010 Brady et al. ..... 219/553
7,703,513 B2 * 4/2010 Vinegar et al. ..... 166/245
7,717,171 B2 * 5/2010 Stegemeier et al. ..... 166/261
7,730,945 B2 * 6/2010 Pieterson et al. ..... 166/272.1
7,730,946 B2 * 6/2010 Vinegar et al. ..... 166/272.3
7,730,947 B2 * 6/2010 Stegemeier et al. ..... 166/272.3
7,735,935 B2 * 6/2010 Vinegar et al. ..... 299/5
2002/0060023 A1 5/2002 Kaihovirta et al.
2002/0179269 A1 12/2002 Klerelid
2004/0128855 A1 * 7/2004 Haider et al. ..... 34/114
2006/0272527 A1 12/2006 Bernard et al.
2007/0039496 A1 2/2007 Sieber et al.
2007/0125251 A1 6/2007 Bernard et al.
2007/0199574 A1 8/2007 Ragosta et al.
2007/0289156 A1 12/2007 Kloibhofer et al.
2008/0004202 A1 1/2008 Wolfgang et al.
2008/0005921 A1 1/2008 Gruber-Nadlinger et al.
2009/0038494 A1 2/2009 Bernard et al.
2009/0126757 A1 5/2009 Marino et al.

* cited by examiner

DRYING CYLINDER

CROSS REFERENCE TO RELATED APPLICATIONS

This is a continuation of PCT application No. PCT/EP2005/056151, entitled "DRYING CYLINDER", filed Nov. 22, 2005.

BACKGROUND OF THE INVENTION

1. Field of the Invention

The invention relates to a drying cylinder for drying a paper, board, tissue or another fibrous web in a machine for producing and/or finishing the same, having a load bearing element and an outer cover layer which is heated by a hot fluid.

2. Description of the Related Art

Drying arrangements having drying cylinders have been known for a long time, the fibrous web wrapping around these being supported by a dryer fabric. As a result of the contact of the fibrous web with the hot circumferential surface, heating occurs and, in particular after being led away from the drying cylinder, evaporation occurs. Because of the limiting drying rate of the drying cylinders, these drying arrangements need a relatively large amount of space. The drying rate is limited substantially by the cover thickness, which is part of the thermal resistance of the drying cylinder. Due to the length of several meters and the diameter of more than one meter the drying cylinders require a relatively thick cylinder shell in order to ensure adequate stability.

What is needed in the art is a device to increase the flow of heat through the shell of a drying cylinder.

SUMMARY OF THE INVENTION

According to the present invention, there is provided a way to increase the flow of heat through the shell and cover layer of the drying cylinder. Between the load bearing element and the outer cover layer, there is at least one cavity, through which the fluid flows. The outer cover layer is predominantly so thin that the ratio of the thermal conductivity of the material and the thickness of the outer cover layer is greater than a limiting value which is 3.2 $kW/m^2K$ for steel, 30 $kW/m^2K$ for aluminum, 18 $kW/m^2K$ for bronze alloys, 3.4 $kW/m^2K$ for copper and 6.1 $kW/m^2K$ for magnesium.

The load bearing element preferably extends axially over the entire drying cylinder and ensures adequate stability of the cylinder. This leads to a substantial relief of the load bearing function of the outer cover layer, so that the latter can be much thinner.

Essentially, the outer cover layer only has to support itself and absorb the internal pressure of the fluid in the cavity. Depending on the construction and extent of the drying cylinder and the support of the outer cover layer, the result is a minimum thickness for the outer cover layer. The upper limit of the thickness of the cover layer is given by the aforementioned limiting value for the corresponding material.

The outer cover layer can be supported on the load bearing element by way of tie rods. This can be done by way of struts, intermediate walls or the like, fixed or form-fitting connections can also be used. However, it may also be advantageous for the load bearing element to carry an inner cover layer which is connected to the outer cover layer by way of connecting elements such as webs, slats or the like, the cavity being formed between the outer and the inner cover layer.

In particular, when the fluid is steam and the pressure in the cavity lies between 1.5 and 13 bar, it should be sufficient to use an outer cover layer with a thickness of between 5 and 15 mm.

In order to improve the transfer of heat from the steam to the outer cover layer, because of the formation of condensate on the inner side of the outer cover layer, it is advantageous to design this inner side to be profiled, even grooved.

In the interest of the greatest possible flow of heat, the ratio, outside of tie rods or connecting elements, should lie above the corresponding limiting value and/or in the case of more than 60%, preferably more than 75%, of the circumferential surface of the outer cover layer, the ratio should at least on average be greater than the corresponding limiting value.

A preferred application of the heated drying cylinder, in addition to the replacement of conventional drying cylinders, results in drying arrangements for a fibrous web in which at least one water-absorbent belt runs around the drying cylinder together with the fibrous web. The fibrous web comes into contact with the drying cylinder and a further, dense belt located on the outside is cooled in the wrap region of the drying cylinder.

In drying arrangements of this type, the steam produced by the heating of the fibrous web during the contact with the heated drying cylinder passes into the water-absorbing belts surrounding the fibrous web as they wrap around the drying cylinder. In these belts, condensation and storage of the condensate occur. After wrapping around, the belts are led away from the fibrous web, cleaned and dried again.

On the belts, the dense belt wraps around the drying cylinder and in this way prevents steam from escaping. This dense belt is normally cooled, thereby intensifying the temperature gradient toward the heated drying cylinder, to predefine the direction of the evaporation from the fibrous web and to intensify the condensation of the steam.

To improve the transfer of heat, it is advantageous if the fibrous web is pressed onto the circumferential surface of the drying cylinder by a belt, preferably a dryer fabric, having a belt tension of at least 10, preferably at least 20 kN/m.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
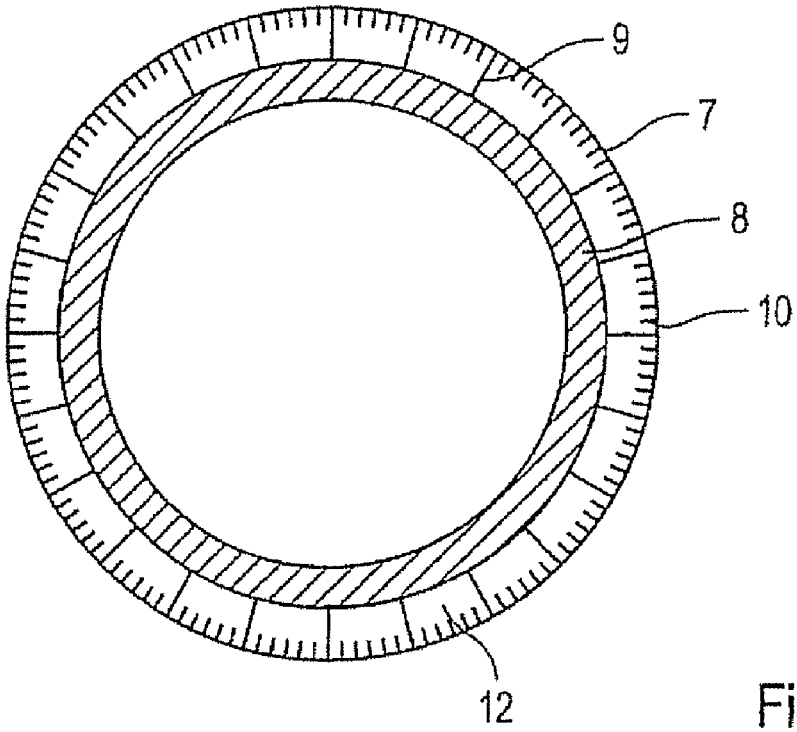
FIG. 1 shows a schematic cross section of an embodiment of a drying cylinder of the present invention.
Figure 2:
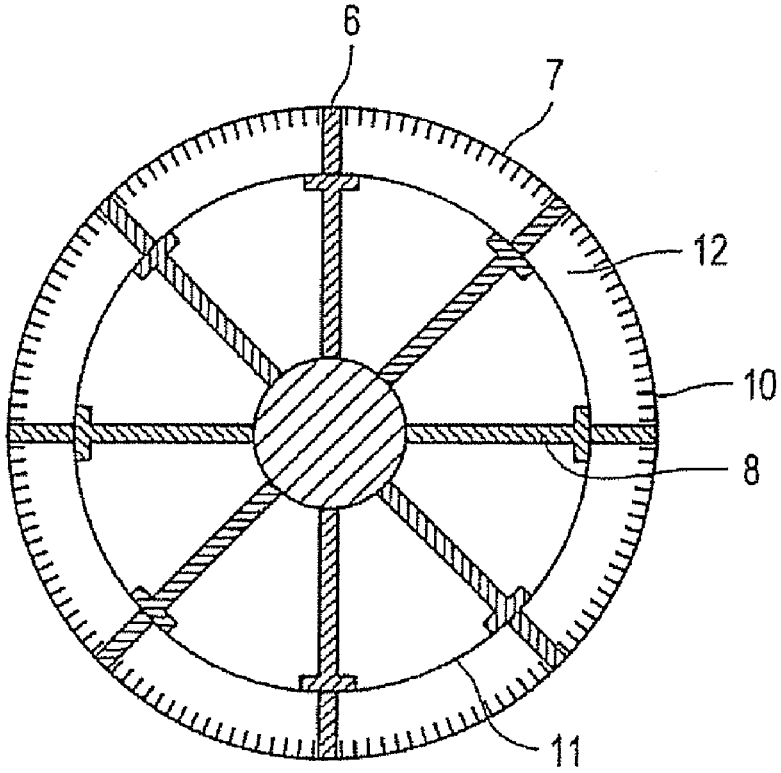
FIG. 2 shows another embodiment of a drying cylinder of the present invention.
Figure 3:
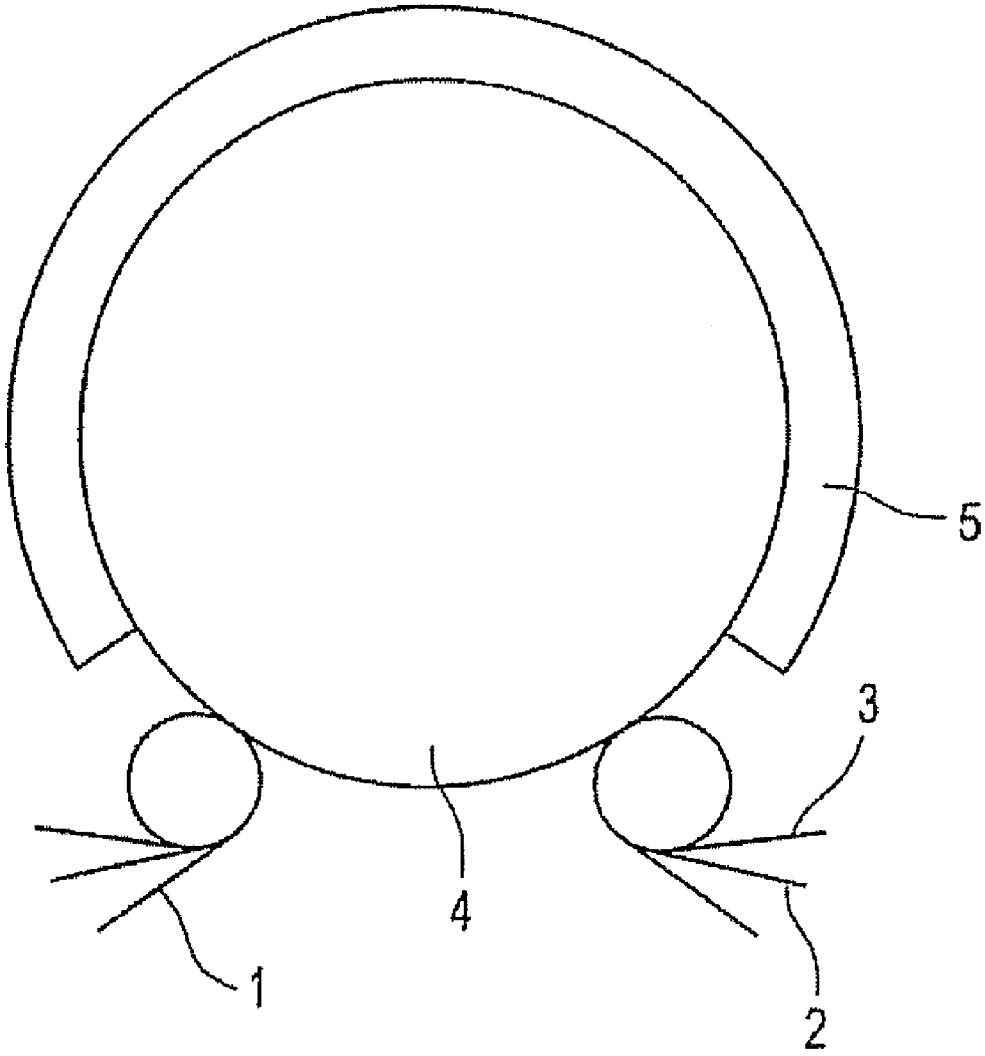
FIG. 3 shows a cross section through a drying arrangement using a drying cylinder of either FIG. 1 or 2.

Referring now to the drawings, and more particularly to FIGS. 1-3, there is shown an important feature of a drying cylinder 4 according to one embodiment of the present invention as an outer cover layer 7 which is as thin as possible and which is stabilized by a load bearing element 8 of drying cylinder 4. Between load bearing element 8 and outer cover layer 7 there are a plurality of cavities 12 running axially, through which hot steam flows. This steam effects heating of outer cover layer 7 and therefore also of fibrous web 1 in contact with the latter.

In order to optimize the flow of heat through outer cover layer 7, it is as thin as possible, depending on the material used. If steel is used here, the ratio A of the thermal conductivity $\lambda$ and the cover thickness s is greater than 3.2 $kW/m^2K$. The thickness of outer cover layer 7 therefore lies between 4 and 18 mm.

In this case, the loss of stability is compensated for by load bearing element 8, which extends axially over the whole of drying cylinder 4. The steam in the cavities has a pressure of between 1.5 and 10 bar and flows axially through cavities 12. The supply and disposal of the steam is carried out by way of rotary connections on drying cylinder 4.

On outer cover layer 7, condensation occurs. In order nevertheless to be able to ensure a good transfer of heat from the steam to outer cover layer 7, the inside of cover layer 7 has ribs 10 which project out of the condensate layer.

In FIG. 1, load bearing element 8 is constructed as a thick-walled cylinder shell which, at the same time, bounds cavities 12. Between load bearing element 8 and outer cover layer 7 there are tie rods 9 arranged and distributed over the circumference, which hold outer cover layer 7 to load bearing element 8 counter to the positive pressure of the steam in cavities 12.

In another embodiment of the present invention, the cavities 12 in FIG. 2 are bounded by an inner cover layer 11 and an outer cover layer 7. Side walls are used as stabilizing connecting elements 6 between these cover layers 7 and 11. Inner cover layer 11 is carried by load bearing element 8.

FIG. 3 shows a preferred application of drying cylinder 4 in a drying arrangement in which fibrous web 1 wraps around drying cylinder 4 together with at least one water-absorbing belt 2 and a belt 3 which is dense with respect to the outside. Dense belt 3 wraps around, belt 2, with dense belt 3 being cooled with water from a hood 5.

The heating of fibrous web 1 during the contact with outer cover layer 7 of drying cylinder 4 leads to evaporation and condensation of the liquid in water-absorbing belt 2. This is further assisted by the temperature gradient between drying cylinder 4 and cooled belt 3.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A drying cylinder for drying one of paper, paperboard, tissue and a fibrous web in a papermaking machine for at least one of producing and finishing the same, the drying cylinder comprising:

a load bearing element; and an outer cover layer directly heated by a hot fluid flowing in contact with said outer cover layer, between said load bearing element and said outer cover layer there is at least one cavity through which the hot fluid flows, at least a portion of said outer cover layer being so thin that a ratio of the thermal conductivity of the material and a thickness of said outer cover layer is greater than a limiting value, which is 3.2 $kW/m^2K$ for steel, 30 $kW/m^2K$ for aluminum, 18 $kW/m^2K$ for bronze alloys, 3.4 $kW/m^2K$ for copper and 6.1 $kW/m^2K$ for magnesium.

2. The drying cylinder of claim 1, further comprising tie rods, said outer cover layer being supported on said load bearing element by way of said tie rods.

3. The drying cylinder of claim 1, further comprising:

an inner cover layer carried by said load bearing element; and a plurality of connecting elements, said inner cover layer being connected to said outer cover layer by way of said connecting elements, said at least one cavity being between said inner cover layer and said outer cover layer.

4. The drying cylinder of claim 3, wherein said connecting elements include at least one of webs and slats.

5. The drying cylinder of claim 1, wherein the hot fluid is steam, a pressure in said at least one cavity being between 1.5 and 13 bar.

6. The drying cylinder of claim 1, wherein said outer cover layer has an inner surface that is profiled.

7. The drying cylinder of claim 6, wherein said inner surface is grooved.

8. The drying cylinder of claim 2, wherein said ratio apart from said tie rods is above said limiting value.

9. The drying cylinder of claim 3, wherein said ratio apart from said connecting elements is above said limiting value.

10. The drying cylinder of claim 1, wherein said portion of said outer cover layer is at least 60% of the entire circumferential surface of said outer cover layer having said ratio that is at least on average greater than said limiting value.

11. The drying cylinder of claim 10, wherein said portion of said outer cover layer is at least 75% of the entire circumferential surface of said outer cover layer having said ratio that is at least on average greater than said limiting value.

12. The drying cylinder of claim 1, wherein said drying cylinder is in contact with a portion of the fibrous web with at least one water-absorbent belt thereover and a dense belt overlying said at least one water-absorbent belt, at least a portion of said dense belt being cooled.

13. The drying cylinder of claim 1, wherein said drying cylinder is in contact with a portion of the fibrous web with a belt thereover, the fibrous web being in contact with said drying cylinder, said belt having a tension of at least 10 kN/m.

14. The drying cylinder of claim 13, wherein said tension is at least 20 kN/m.

15. The drying cylinder of claim 13, wherein said belt is a dryer fabric.

16. A papermaking machine producing a fibrous web, the papermaking machine comprising:

a drying cylinder including:

a load bearing element; and an outer cover layer heated by a hot fluid, between said load bearing element and said outer cover layer there is at least one cavity through which the hot fluid flows in direct contact with said outer cover layer, at least a portion of said outer cover layer being so thin that a ratio of the thermal conductivity of the material and a thickness of said outer cover layer is greater than a limiting value, which is 3.2 $kW/m^2K$ for steel, 30 $kW/m^2K$ for aluminum, 18 $kW/m^2K$ for bronze alloys, 3.4 $kW/m^2K$ for copper and 6.1 $kW/m^2K$ for magnesium;

at least one water-absorbent belt, said water-absorbent belt along with the fibrous web wrapping about a portion of said drying cylinder, the fibrous web being in contact with said drying cylinder; and a dense belt overlying said at least one water-absorbent belt about said portion of said drying cylinder, at least one portion of said dense belt being cooled.

17. A papermaking machine producing a fibrous web, the papermaking machine comprising:

a drying cylinder including:

a load bearing element; and an outer cover layer directly heated by a hot fluid, between said load bearing element and said outer cover layer there is at least one cavity through which the hot fluid flows, at least a portion of said outer cover layer being so thin that a ratio of the thermal conductivity of the material and a thickness of said outer cover layer is greater than a limiting value, which is 3.2 $kW/m^2K$ for steel, 30 $kW/m^2K$ for aluminum, 18 $kW/m^2K$ for bronze alloys, 3.4 $kW/m^2K$ for copper and 6.1 $kW/m^2K$ for magnesium; and a belt along with the fibrous web wrapping about a portion of said drying cylinder, the fibrous web being in contact with said drying cylinder, said belt having a tension of at least 10 kN/m.

18. The papermaking machine of claim 17, wherein said tension is at least 20 kN/m.

19. The papermaking machine of claim 17, wherein said belt is a dryer fabric.

* * * * *